US008052077B2

(12) United States Patent
Thiel et al.

(10) Patent No.: US 8,052,077 B2
(45) Date of Patent: Nov. 8, 2011

(54) METHOD FOR PREPARING A CARBON SICCATIVE FOR PRODUCING ELECTRODES

(75) Inventors: Jens-Peter Thiel, Horneburg (DE); Thore Möller, Stade (DE)

(73) Assignee: Claudius Peters Technologies GmbH, Buxtehude (DE)

( * ) Notice: Subject to any disclaimer, the term of this patent is extended or adjusted under 35 U.S.C. 154(b) by 960 days.

(21) Appl. No.: 11/661,434

(22) PCT Filed: Sep. 2, 2004

(86) PCT No.: PCT/EP2004/009798

§ 371 (c)(1), (2), (4) Date: Feb. 28, 2007

(87) PCT Pub. No.: WO2006/024315

PCT Pub. Date: Mar. 9, 2006

(65) Prior Publication Data

US 2007/0284463 A1 Dec. 13, 2007

(51) Int. Cl.
*B02C 15/00* (2006.01)

(52) U.S. Cl. ..... 241/19; 241/36; 241/119

(58) Field of Classification Search ..... 241/119, 241/34, 35, 36, 19
See application file for complete search history.

(56) References Cited

U.S. PATENT DOCUMENTS

| | | | | |
|---|---|---|---|---|
| 4,225,091 | A * | 9/1980 | Steier | 241/24.1 |
| 4,684,069 | A * | 8/1987 | Hashimoto et al. | 241/79.1 |
| 4,689,141 | A * | 8/1987 | Folsberg | 209/714 |
| 4,694,994 | A * | 9/1987 | Henne et al. | 241/79.1 |
| 4,798,342 | A * | 1/1989 | Williams | 241/18 |
| 4,981,269 | A * | 1/1991 | Koga et al. | 241/30 |
| 5,330,110 | A * | 7/1994 | Williams | 241/53 |
| 6,194,067 | B1 | 2/2001 | Hamada et al. | |
| 6,966,508 | B2 * | 11/2005 | Levy et al. | 241/119 |

FOREIGN PATENT DOCUMENTS

DE 40 22 062 A1 1/1993

* cited by examiner

*Primary Examiner* — Faye Francis
(74) *Attorney, Agent, or Firm* — Alix, Yale & Ristas, LLP

(57) ABSTRACT

A method for preparing a carbon siccative for producing electrodes. The dust fraction is produced continuously by a mill/sifter combination with a grain size or specific surface area adjustable during operation, preferably by a roller grinding mill with an integrated sifter.

2 Claims, 1 Drawing Sheet

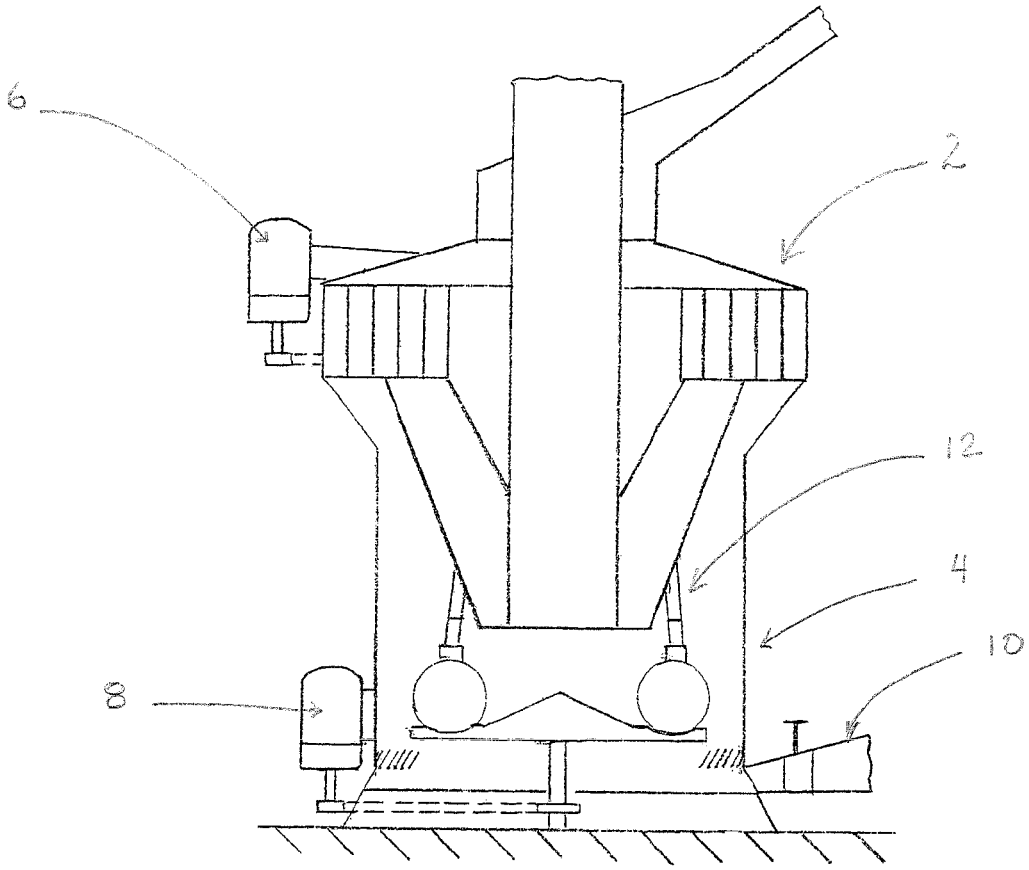
6
2
12
4
10
8

METHOD FOR PREPARING A CARBON SICCATIVE FOR PRODUCING ELECTRODES

BACKGROUND

Electrodes mainly used for electrometallurgic processes are produced by pressing granular carbon masses (siccative) with the addition of pitch as a binder. The electrode quality depends critically on adhering to a predetermined grain size spectrum in the siccative. Coarse grain, medium grain and fine grain must be represented in defined ratio quantities in this, depending on the type of electrode and the raw material. It is particularly important in this case to maintain a predetermined quality of the fine material. In the context of the invention, this includes mainly what is known as the dust fraction, the medium grain size of which lies, as a rule, around 30 to 60 μm according to a specific surface area of 5000 to 2000 cm2/g.

In known production methods (DE-A-4122062), the individual fractions are broken or ground and are finally graded and deposited in separate metering silos, in order to be drawn off from these in a desired ratio according to the respective recipe. The dust fraction is ground and homogenized separately in a tube mill (ball mill), before it is likewise deposited in metering silos. This method has the disadvantage that it can be varied only with great difficulty when a recipe change or fluctuations in the quality of the raw material demand an adjustment. For setting the dust properties as a function of the grindability of the coke and of the respective changing requirements, the known method is carried out in start/stop operation, thus leading to an irregular dust quality in terms of throughput, fineness and specific surface area. This results in a varying pitch requirement and undesirably fluctuating physical properties of the electrodes.

A method which can be influenced more easily with a view to achieving specific properties of the dust-like or fine-grained target fraction is provided.

SUMMARY

A mill/sifter combination with a grain size adjustable continuously during operation is used for grinding the dust fraction. It has proved particularly appropriate to use a roller grinding mill with an integrated sifter, in which the grinding pressure and preferably the mill rotational speed and the air throughput through the mill and the sifter are adjustable. The sifter used is preferably a dynamic sifter, in which the rotational speed should be adjustable for the purpose of adjusting the grain boundaries.

BRIEF DESCRIPTION OF THE DRAWINGS

The sole FIGURE shown is a schematic of a mill/sifter combination.

DETAILED DESCRIPTION

What is meant by a mill/sifter combination is a functional connection of a mill to a sifter in which the oversize separated out by the sifter is recirculated into the mill. This combination allows a particularly fine setting without any substantial idle times, because both the properties of the sifter and those of the mill can be influenced. What is achieved thereby is the continuous production of predetermined dust quantities of any desired finenesses, along with varying grindability due to the adaptation of the rotational speed, the pressure force, the system air quantity and/or the sifter rotational speed.

The FIGURE shows a mill/sifter configuration including an integrated dynamic sifter 2 and a roller grinding mill 4. An adjustable sifter drive 6 is provided for driving the dynamic sifter 2 and an adjustable mill drive 8 is provided for drawing the roller grinding mill. An adjustable air input 10 is provided for providing air throughput. Adjustable grinding pressure is provided by means indicated at 12.

To take into account different hardnesses of the raw material, the grinding pressure can be adjusted. Since the petroleum coke mostly used as raw material is unusually hard, the grinding pressure is set twice to three times as high as in conventional coal grinding. The system air quantity, that is to say the intensity of the airstream which carries the ground fine material out of the grinding zone to the sifter, may be set lower if a lower maximum grain size is desired, and vice versa. The maximum grain size may also be influenced by the rotational speed of the dynamic sifter. Further parameters for influencing the grain size may apply, depending on the type of sifter.

The sifter is preferably of a known dynamic type, in which the airstream laden with ground material is led to the mill from the outside inward by a ring of tangentially arranged guide blades and is thereby set in circular motion. Further inward, it arrives on a spiral path at a rotary basket which is operated at an adjustable rotational speed. The fine particles penetrate through the gaps of the rotary basket together with the airstream, whereas the coarser particles are thrown out of it again, in order to fall downward in the space between the guide blades and rotary basket and to be delivered from there to the grinding process again. The fine material leaves the sifter together with the airstream, and its fineness can be determined via the setting of the rotational speed of the rotary basket and via the intensity of the airstream.

Since reaction to fluctuations in the quality of the raw material can take place quickly and continuously during operation, and since the desired grain size range can be accurately maintained continuously, the fine material thus obtained and continuously extracted from the airstream in a known way does not require any further subsequent homogenization. It can be directly supplied continuously to a silo from which it is extracted directly or indirectly, preferably continuously, for use. This silo may also be dimensioned smaller than has been customary hitherto, because there is no need to take into account any mill changeover times in the event of a change in quality. Even when parameters of the grinding or sifting operation have to be adapted on account of changes in the quality of the raw material or changes in the recipe, the mill/sifter combination can continue to be operated continuously. If a fundamental recipe change becomes necessary, the changeover can take place in a few minutes. The product possibly occurring in the changeover phase and not conforming to the target quality can be briefly stored intermediately in a silo and subsequently be delivered to the mill again. In practice, continuous operation is not interrupted as a result of this. The change of operation preferably takes place by computer control, programmed master controls being employed in order to avoid or to minimize the occurrence of intermediate product (grinding loss). The product occurring, for example, as grinding loss is intercepted in an intermediate silo and is admixed to the feed material, preferably by computer control, such that no product waste polluting the environment is obtained.

All types of roller grinding mills (ball roller mills, roller disk mills, roller bowl mills up to and including single-roller mills) may be employed. All grindable carbon carriers, up to and including the hardest petroleum cokes, may be processed. The siccatives may be prepared for all types of electrodes with the most diverse requirements as to hardness and fineness. The bandwidth of the granulations capable of being produced is very wide. It is preferably in the range of 1,000 to 10,000 cm2/g.

Whereas it has been necessary hitherto to produce different fractions, staggered in time, and to store the product intermediately in separate silos, the grinding operation can now be incorporated continuously and simultaneously into the production operation. Since silo storage is both avoided and facilitated and, in particular, large silos are avoided, the hitherto often extremely disturbing problem of the segregation of different granulations within the silos is avoided.

The invention claimed is:

1. A method for preparing a carbon siccative for producing electrodes, in which fractions of different granulation are produced and are mixed in a predetermined ratio, and in which the fractions comprise at least one dust to fine-grained fraction which is ground to a predetermined adjustable grain size, said method comprising:

providing a mill/sifter combination in which the grain size is continuously adjustable during operation, said mill/sifter combination being a roller grinding mill with an integrated dynamic sifter wherein the grinding pressure of said mill is adjusted, the rotational speed of the mill is adjusted, the air throughput of the mill and sifter is adjusted, and the rotational speed of the sifter is adjusted; and using said mill/sifter combination to grind the dust to fine-grained fraction whereby further subsequent homogenization is not required.

2. The method as claimed in claim 1 characterized in that the operation of the mill/sifter combination can be varied for any fluctuations in the quality of the raw material or for recipe changes during continuous operation.

* * * * *